US005536144A

United States Patent [19]

Bednarz et al.

[11] Patent Number: 5,536,144

[45] Date of Patent: Jul. 16, 1996

[54] TURBOCHARGER TURBINE WHEEL AND SHAFT ASSEMBLY

[75] Inventors: Stephen M. Bednarz, Naperville; Charles H. McCreary, Oak Park; James W. Heilenbach, Riverside, all of Ill.

[73] Assignee: General Motors Corporation, Detroit, Mich.

[21] Appl. No.: 322,752

[22] Filed: Oct. 13, 1994

[51] Int. Cl.[6] ..... F01D 5/02

[52] U.S. Cl. ..... 416/198 A; 416/244 A

[58] Field of Search ..... 417/407, 409; 416/198 A, 244 A

[56] References Cited

U.S. PATENT DOCUMENTS

| | | | |
|---|---|---|---|
| 2,801,070 | 7/1957 | Purvis et al. | 416/244 A |
| 3,356,339 | 12/1967 | Thomas et al. | 416/198 A |
| 4,123,199 | 10/1978 | Shimizu et al. | 416/244 A |
| 5,163,816 | 11/1992 | Goetzke | 416/244 A |

OTHER PUBLICATIONS

Abstract of *Turbine Apparatus,* Albert S. Thompson, Westinghouse Electric Corporation, published Jan. 30, 1951 at 642 O.G. 1479.

*Primary Examiner*—Michael Koczo

*Attorney, Agent, or Firm*—Charles K. Veenstra

[57] ABSTRACT

A turbine wheel for a turbocharger or the like is mounted to an impeller shaft and optionally an additional drive shaft by annular rows of coupling teeth preferably of the CURVIC™ coupling type having radially and rotationally locking convex sided and concave sided interlocking teeth. Flexible webs connecting coupling rings on the turbine allow thermo and mechanical growth of the turbine wheel without excessive deflection of the coupling rings and the associated shaft flanges. A single central stud threaded into one of the shafts and retained by a bolt against the other maintains the components in assembly with the coupling teeth fully engaged. A radial slot formed in the coupling flange for one of the shafts prevents thermal distortion of the flange from substantially affecting an adjacent thrust bearing portion of the flange. The arrangement simplifies rotor assembly and avoids the need for rebalancing after disassembly and reassembly. The full width of the coupling teeth are available for the transmission of torque and radial alignment forces.

4 Claims, 3 Drawing Sheets

TURBOCHARGER TURBINE WHEEL AND SHAFT ASSEMBLY

TECHNICAL FIELD

This invention relates to turbochargers for engines, especially, but not exclusively, of the two cycle diesel type wherein a speed increasing planetary gear drive train is provided. More particularly the invention relates to a turbine wheel and shaft assembly and means for coupling the turbine wheel to an impeller and, optionally, a drive shaft.

BACKGROUND

U.S. Pat. No. 5,163,816 Goetzke et al. describes engine turbocharger assemblies having novel arrangements for mounting a compressor impeller wheel on a shaft connecting with a turbine wheel for use in a turbocharger or the like. In FIG. 1 of this patent, a turbocharger arrangement is shown in which the turbine wheel is formed as part of the shaft on which the impeller wheel is mounted and a gear-driven drive shaft is connected with the turbine wheel through a plurality of bolts spaced around a hub and flange connection in known manner. The multiple bolted connection complicates the assembly and disassembly of the turbocharger, as well as requiring rebalancing of the assembly when turbocharger rotors are reassembled.

SUMMARY OF THE INVENTION

The present invention provides an improved arrangement for mounting a turbine wheel to a shaft, such as an impeller shaft and optionally also to a drive shaft, to form a turbine wheel and shaft assembly, or rotor, for use in an engine turbocharger or the like. In accordance with the invention, the turbine wheel and its associated impeller and/or drive shafts are connected by annular rows of coupling teeth extending axially from flanges of the associated impeller and drive shafts and engaging mating coupling teeth on outward end faces of the turbine wheel. The coupling teeth are preferably of the so called CURVIC™ coupling type in which concave sided teeth on one of the engaged coupling members mate with convex sided teeth on the other member to provide lash free engagement for transfer of both rotational torques and radial positioning loads.

Flexible webs connecting turbine wheel coupling rings with the main body permit radial growth of the turbine wheel to flex the webs and minimize related movement of the coupling rings and connected flanges. Retention of the components of the rotatable assembly by a single axially extending stud, secured in one of the shafts and held by a nut against a shoulder at the opposite shaft end, simplifies assembly and disassembly of the rotor. The accuracy of the coupling teeth minimizes the need for rebalancing upon reassembly. Distortion of a thrust bearing flange adjacent to the coupling flange on the associated drive or impeller shaft is minimized by forming a slot between the thrust and coupling flange elements.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
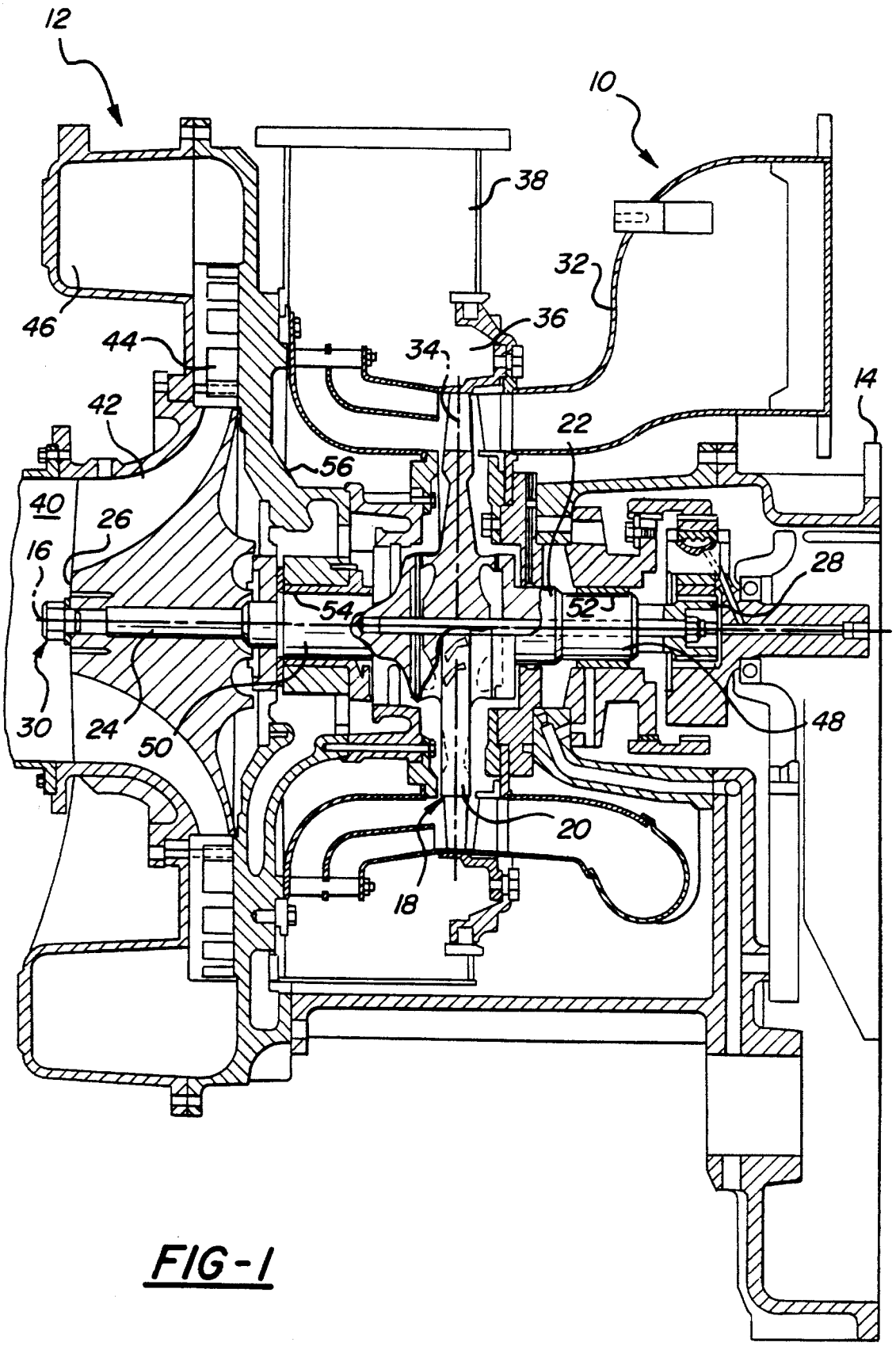
FIG. 1 is a cross-sectional view of pertinent portions of a turbocharger assembly having a turbine wheel and shaft assembly according to the invention.

Referring now to FIGS. 1–5 of the drawings in detail, and FIG. 1 in particular, numeral 10 generally indicates a turbocharged two stroke cycle medium speed diesel engine, particularly of the railway locomotive type previously referred to. The engine 10 has a fabricated crankcase, not shown, at the rear of which there is mounted a gear and exhaust gas driven turbocharger generally indicated by numeral 12.

The turbocharger 12 includes a housing 14 supporting, for rotation on an axis 16, a turbine wheel and shaft assembly 18 that includes a turbine wheel 20, a drive shaft 22 and an impeller shaft 24. A compressor impeller wheel 26 is mounted on the far end of the impeller shaft 24 and a sun gear 28 is integral with the opposite far end of the drive shaft 22. The manner of mounting the impeller wheel is optional but, as illustrated, is similar to that of FIG. 5 in U.S. Pat. No. 5,163,816, except that the drive insert of the patent is omitted and the impeller wheel 26 is directly secured to the shaft 24. The turbine wheel and shaft assembly 18 together with the impeller 26 may be referred to as the rotor 30.

The turbine wheel 20 is driven by exhaust gases discharged from the engine cylinders, not shown, and directed through an inlet duct and scroll 32 against blades 34 on the turbine wheel, where a portion of the exhaust energy is utilized for turning the rotor. The exhaust gases are then received in a collector chamber 36 and discharged through an exhaust duct 38. The sun gear 28, at the far end of the drive shaft from the associated turbine wheel 20 is part of a planetary gear set in a gear train for driving the rotor 30 when the exhaust energy is insufficient for the purpose.

Rotation of the rotor 30 turns the impeller wheel 26, drawing in ambient air through an inlet duct 40 to rotating blades 42 on the impeller wheel, where the air is compressed. The compressed inlet air is then discharged through a diffuser 44 to an outlet scroll 46 from which it is carried by duct means, not shown, to the engine cylinders. The rotor 30 is rotatable on a pair of bearing journals 48, 50, located on opposite sides of the turbine wheel, between it and the overhung sun gear 28 and compressor impeller wheel 26, respectively. The journals are respectively carried in a gear end bearing 52 and a compressor sleeve bearing 54. Bearing 54 is supported in a compressor bearing support member 56 which is a separate part of the housing 14 and also forms a portion of the outlet scroll 46.

Figure 2:
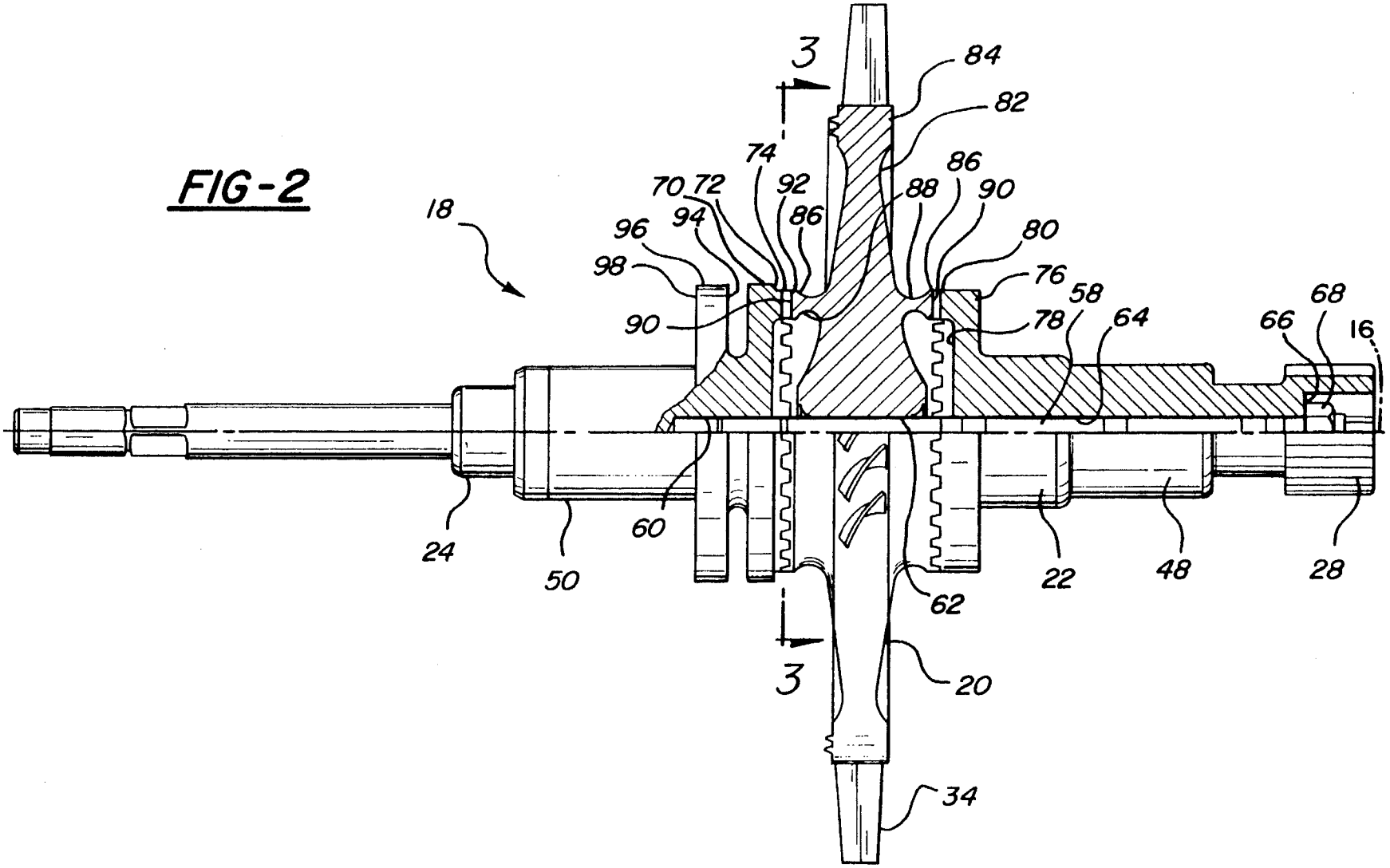
FIG. 2 is a side view partially in cross section of a turbine wheel and shaft assembly according to the invention.
Figure 3:
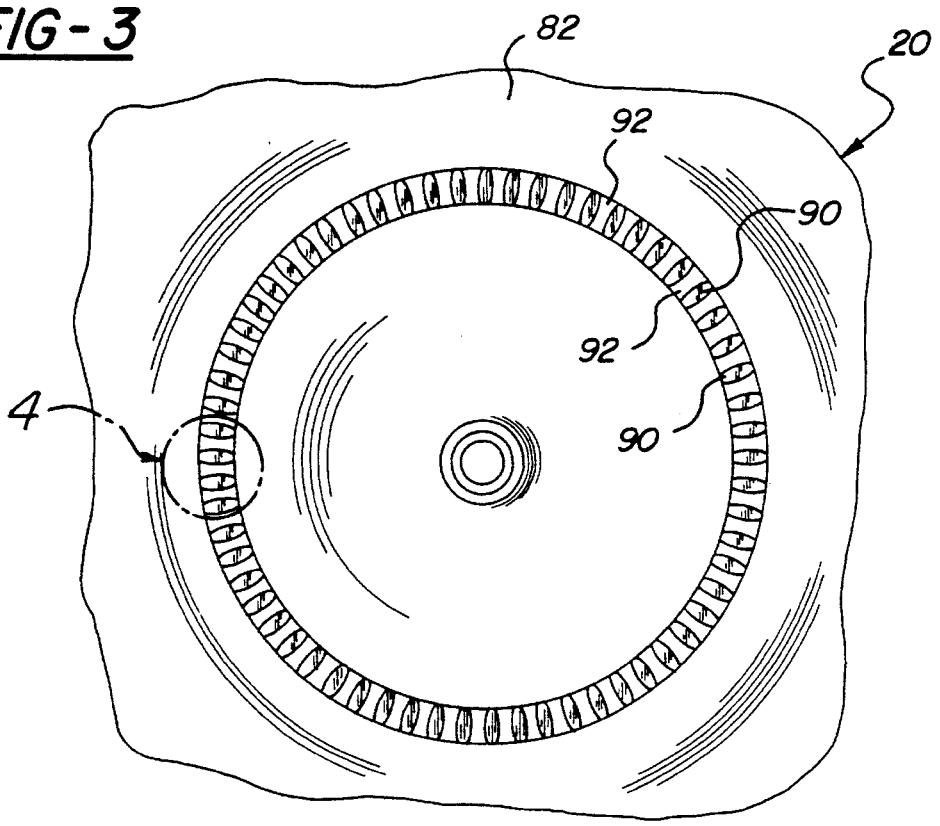
FIG. 3 is an end view from the plane of the line 3—3 of FIG. 2 showing the toothed coupling portion of the turbine wheel.

In accordance with the invention, the turbine wheel and shaft assembly 18, as best shown in FIG. 2, includes several significant improved features. Instead of the usual flange bolting, the turbine wheel, impeller shaft, and drive shaft elements are retained in assembly by a central stud 58 which engages a threaded opening 60 in the inner end of the impeller shaft and extends through axial openings 62, 64 in the turbine wheel and the drive shaft, respectively. A shoulder 66 within the sun gear 28 is engaged by a nut 68 threaded on to the outer end of the stud 58 to secure the assembly together. The single stud 58, located along the rotational axis 16 of the assembly, replaces the multiple flange bolts previously used.

The impeller shaft 24 has at its inner end a turbine mounting flange 70 having an end face 72 with a ring of coupling teeth 74 extending axially from the end face 72 toward the turbine wheel 20. The drive shaft 22 similarly has a turbine mounting flange 76 on its inner end having an end face 78 and a second ring of coupling teeth 80 extending axially inward from the end face 78 toward the turbine wheel 20. The turbine wheel includes a disk-like body 82 narrowed at its outer diameter adjacent a blade mounting rim 84 and increasing in thickness toward its inner diameter to provide strength with a minimum of centrifugal mass.

Figure 4:
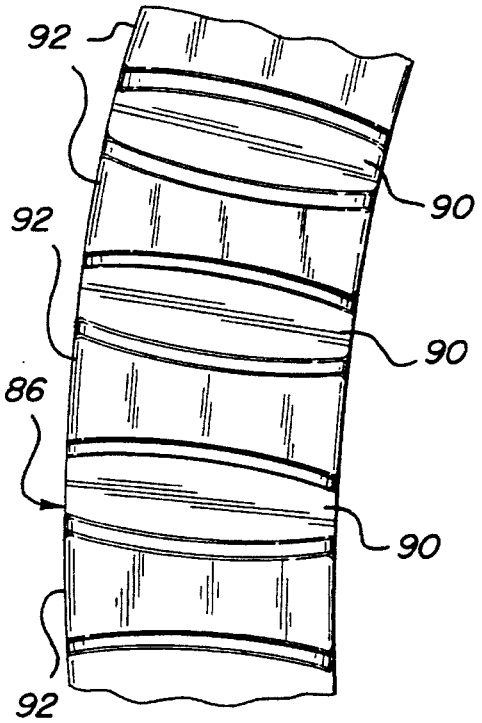
FIG. 4 is an enlarged end view of the turbine wheel coupling teeth shown in the circle 4 of FIG. 3.
Figure 5:
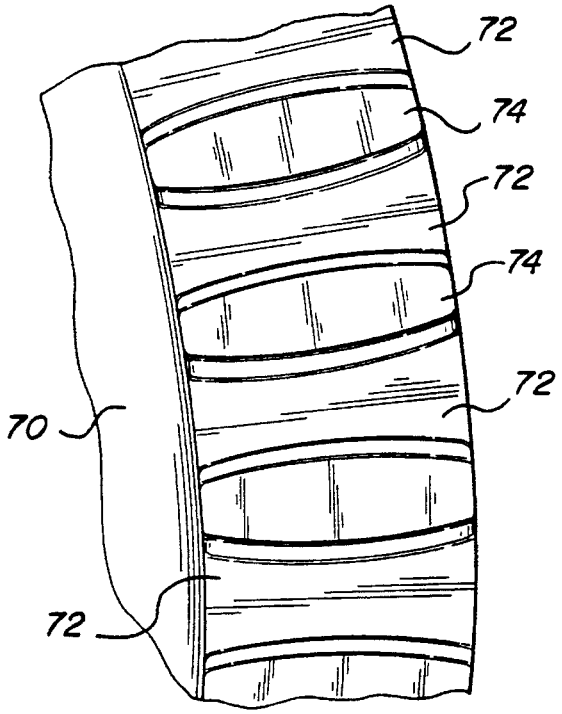
FIG. 5 is an enlarged end view of the impeller shaft coupling teeth configured for mating with the turbine wheel coupling teeth of FIG. 4.

Spaced axially on either side of the body 82 are circular rings 86 each of which is connected with the body by an annular ligament or web 88 of reduced radial thickness and having radial resilience that allows limited flexing of the ring. On their inner sides, the rings 86 have end faces 90 from each of which a mating ring of coupling teeth 92 extends axially outward into mating engagement with the coupling teeth 74, 80 of the respective flanges. Preferably the coupling teeth take the form of a so-called CURVIC™ coupling in which the teeth 92 on the turbine wheel are formed with concave sides separated by convexly-sided openings and the mating teeth 74, 80 on the flanges 70, 76 of the impeller and drive shafts have convex sides separated by concavely-curved spaces. These configurations are best shown in FIGS. 4 and 5. Upon assembly, the concave sided teeth 92 of the turbine wheel interlock with the convex sided teeth 74, 80 of the flanges and positively locate and center the turbine wheel with respect to the impeller and turbine drive shafts for rotation of the axis 16. The mating teeth are angled with respect to the axial direction and are maintained in positive engagement upon assembly by the single axially extending stud and nut retainer so that there is no possibility of slippage and the maximum tooth surface is available for transmitting torque between the shafts and the turbine wheel.

Since, in operation, the heat applied to the turbine wheel blades 34 is transmitted into the body 82 and causes substantial radial expansion, together with radial distortion that occurs due to the high rotational speed of the turbine, the annular ligaments or webs 88 connecting the rings 86 with the body 82 allow radial growth or deflection of the turbine wheel 20 to be accommodated with lesser deflection of the connecting flanges 70, 76. However, some axially outward bending of the flanges will occur within the limits of the design constraints. For this reason, a slot 94 is provided between the flange 70 of the impeller shaft and an axially adjacent flange 96, the outer face 98 of which forms a surface for engagement with a thrust bearing within the turbine assembly. The slotted flange arrangement reduces deflection of the thrust bearing face 98 due to distortion of toothed flange 70 during operation.

As a result of the described features, the rotating assembly or rotor can be easily disassembled and reassembled without rebalancing since the relative locations of the parts are fixed by the mating coupling teeth. In addition, assembly of the turbine wheel and shaft assembly is greatly simplified over the prior arrangement which used multiple bolts around a central hub of the turbine wheel.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A turbine wheel and shaft assembly for an engine turbocharger, said assembly comprising:

an impeller shaft for rotatably driving an impeller wheel on a rotational axis, said shaft including bearing means spaced intermediate impeller attaching means at one end and a turbine mounting flange at another end, said flange having an end face and a ring of coupling teeth extending axially from said flange end face;

a turbine wheel having, an outer row of turbine blades and a first axial end face with a mating ring of coupling teeth extending axially from said first end face; and fastener means securing the turbine wheel to the impeller shaft for rotation on said axis with the coupling teeth of said flange end face and said first end face in engagement, said coupling teeth being configured to center and support the wheel on the shaft and to transmit torque therebetween;

wherein said toothed first end face of the turbine wheel is formed on a circular rim connected axially with the turbine wheel by an annulus having radial resilience that allows flexing of the rim to at least partially accommodate thermal and mechanical growth of the turbine wheel during operation;

wherein said coupling teeth are further configured to radially lock together said turbine mounting flange end face and said circular rim such that outward movement of the rim caused by operational turbine wheel growth results in a corresponding outward motion and bending of said flange; and wherein said impeller shaft includes a thrust bearing flange adjacent said turbine mounting flange, the flanges being axially separated by a circumferential groove to minimize bending of the thrust bearing flange during operational bending of the turbine mounting flange and to limit heat flow between the flanges.

2. An assembly as in claim 1 wherein said coupling teeth are formed as CURVIC™ coupling teeth.

3. A turbine wheel and shaft assembly for an engine turbocharger, said assembly comprising:

an impeller shaft for rotatably driving an impeller wheel on a rotational axis, said impeller shaft including bearing means spaced intermediate impeller attaching means at one end and a first turbine mounting flange at another end, said first flange having an end face and a first ring of coupling teeth extending axially from said first flange end face;

a drive shaft for optionally rotatably driving the impeller wheel, said drive shaft including bearing means spaced intermediate drive connecting means at one end and a second turbine mounting flange at another end, said second flange having an end face and a second ring of coupling teeth extending axially from said second flange end face:

a turbine wheel having an outer row of turbine blades and oppositely facing first and second axial end faces each with a mating ring of coupling teeth extending axially from its respective end face: and fastener means securing the turbine wheel to the impeller shaft for rotation on said axis with the coupling teeth on the end faces of said first and second flanges and the mating coupling teeth of said turbine wheel first and second end faces in engagement, said coupling teeth being configured to center and support the wheel on the shaft and to transmit torque therebetween;

wherein said toothed first and second end faces of the turbine wheel are formed on circular rims connected axially with the turbine wheel by annuli having radial resilience that allows flexing of the rims to at least partially accommodate thermal and mechanical growth of the turbine wheel during operation;

wherein said coupling teeth are further configured to radially lock together said turbine mounting flange end faces and said circular rims such that outward movement of the rims caused by operational turbine wheel growth results in a corresponding outward motion and bending of said flange; and wherein said impeller shaft includes a thrust bearing flange adjacent said first turbine mounting flange, these flanges being axially separated by a circumferential groove to minimize bending of the thrust bearing flange during operational bending of the turbine mounting flange and to limit heat flow between these flanges.

4. An assembly as in claim 3 wherein said coupling teeth are formed as CURVIC™ coupling teeth.

* * * * *